US006603050B2

(12) United States Patent
Heaton

(10) Patent No.: US 6,603,050 B2
(45) Date of Patent: Aug. 5, 2003

(54) DESTRUCTION OF ENERGETIC MATERIALS

(75) Inventor: Harley L. Heaton, Manasses, VA (US)

(73) Assignee: UXB International, Inc., Ashburn, VA (US)

( * ) Notice: Subject to any disclaimer, the term of this patent is extended or adjusted under 35 U.S.C. 154(b) by 106 days.

(21) Appl. No.: 09/789,109

(22) Filed: Feb. 20, 2001

(65) Prior Publication Data

US 2001/0049463 A1 Dec. 6, 2001

Related U.S. Application Data

(60) Provisional application No. 60/184,338, filed on Feb. 23, 2000.

(51) Int. Cl.[7] ..... A62D 3/00
(52) U.S. Cl. ..... 588/203; 588/205; 588/221
(58) Field of Search ..... 588/200, 203, 588/205, 221

(56) References Cited

U.S. PATENT DOCUMENTS

| | | | | |
|---|---|---|---|---|
| 2,659,659 A | | 11/1953 | Schmidl | |
| 3,006,755 A | | 10/1961 | Adams | |
| 3,437,654 A | | 4/1969 | Dix | |
| 3,637,686 A | | 1/1972 | Kokubo et al. | |
| 3,778,320 A | | 12/1973 | Yosim et al. | |
| 4,018,676 A | | 4/1977 | Hoffsommer et al. | |
| 5,250,161 A | | 10/1993 | Chin et al. | |
| 5,284,995 A | | 2/1994 | Melvin | |
| 5,314,550 A | | 5/1994 | Nahlovsky et al. | |
| 5,331,106 A | | 7/1994 | Spas | |
| 5,445,690 A | * | 8/1995 | Wulfman | 149/109.6 |
| 5,516,971 A | | 5/1996 | Hurley | |
| 5,523,517 A | * | 6/1996 | Cannizzo et al. | 149/124 |
| 5,538,530 A | | 7/1996 | Heaton et al. | |
| 5,763,736 A | | 6/1998 | Daume | |
| 5,998,691 A | | 12/1999 | Abel et al. | |
| 6,049,021 A | | 4/2000 | Getman et al. | |
| 6,080,906 A | | 6/2000 | Johnson et al. | |
| 6,121,506 A | | 9/2000 | Abel et al. | |
| 6,388,164 B1 | * | 5/2002 | Desmare et al. | 588/202 |

FOREIGN PATENT DOCUMENTS

| | | |
|---|---|---|
| DE | 4036787 A | 5/1992 |
| DE | 4115435 C | 8/1992 |
| DE | 19520548 A | 12/1996 |

OTHER PUBLICATIONS

Spontarelli et al, "Destruction of Waste Energetic Materials Using Base Hydrolysis," Proceedings of the 1993 Incineration Conference (Knoxville, TN, May 3–7, 1993), pp. 787–791.*

Chemical Abstracts, vol. 130, No. 5, Feb. 1, 1998, Columbus, Ohio, U.S.; Abstract No. 54464a. R. Flesner et al.: "Pilot–scale base hydrolysis processing of HMX–based plastic–bonded explosives". p. 835; XP000861211. Abstract & NATO Sci. Ser., 1, 1998. 22 (Effluents from Alternative Demilitarization Technologies), pp. 35–45.

* cited by examiner

*Primary Examiner*—Steven Bos
*Assistant Examiner*—Anthony Kuhar
(74) *Attorney, Agent, or Firm*—Nixon & Vanderhye, P.C.; Frank P. Presta

(57) ABSTRACT

Improved apparatus and approaches are described for destruction of energetic materials. The approaches include hydrolysis of the energetic materials by combining a volatile base and water with the energetic materials. The unreacted base from the hydrolysis reaction mixture is recovered and reused for further hydrolysis of energetic materials. The apparatus include components suitable for recovering and reusing unreacted base.

16 Claims, 2 Drawing Sheets

DESTRUCTION OF ENERGETIC MATERIALS

CROSS REFERENCE TO RELATED APPLICATIONS

This application claims priority to U.S. Provisional Application No. 60/184,338, titled LOW COST METHOD FOR DESTRUCTION OF ENERGETIC MATERIALS filed on Feb. 23, 2000, incorporated herein by reference.

BACKGROUND OF THE INVENTION

This invention relates to destruction of energetic materials such as explosives and propellants. The invention more particularly relates to improved methods and apparatus for destruction of energetic materials.

In recent years a number of international treaties and agreements have committed nations around the world to reduce weapons arsenals. Safe disposal of these weapons is particularly desirable. These weapons generally include energetic materials that are explosives and/or propellants.

Disposal of energetic materials is conventionally effected by means of open burning/open detonation (OB/OD). OB/OD is currently used to destroy or render inert excess, obsolete or unstable explosives and propellants. The use of OB/OD, however, results in large clouds of pollutants being released into the atmosphere and is being increasingly restricted, banned or regulated by law. In addition, OB/OD results in noise pollution and quality of life issues for nearby residents and has resulted in soil and water contamination at sites where it has been practiced.

A number of alternative methods have been described for disposal of energetic materials. Hydrolysis reactions have been used for the destruction of energetic materials which include, for example, nitro aromatic compounds and nitrate esters.

The safe destruction of energetic materials can require considerable monetary resources for agencies charged with the responsibility of carrying out these tasks. Emphasis has been placed more recently in developing more cost efficient protocols for destruction of energetic materials while reducing environmental contamination.

SUMMARY OF THE INVENTION

In a first aspect, the invention relates to an apparatus for conversion of energetic materials. The apparatus comprises a tank having a first inlet being connected to a source of water and energetic materials, a second inlet being connected to a base dispenser and a first outlet. The apparatus also comprises a base processor operatively connected to the first outlet of the tank, wherein the base processor comprises a compressor.

In another aspect, the invention pertains to a method for converting energetic materials. The method comprises combining a volatile base with energetic materials and water to obtain a reaction mixture that hydrolyzes the energetic materials. The method further comprises recovering unreacted base.

DETAILED DESCRIPTION OF THE PREFERRED EMBODIMENTS

Figure 1:
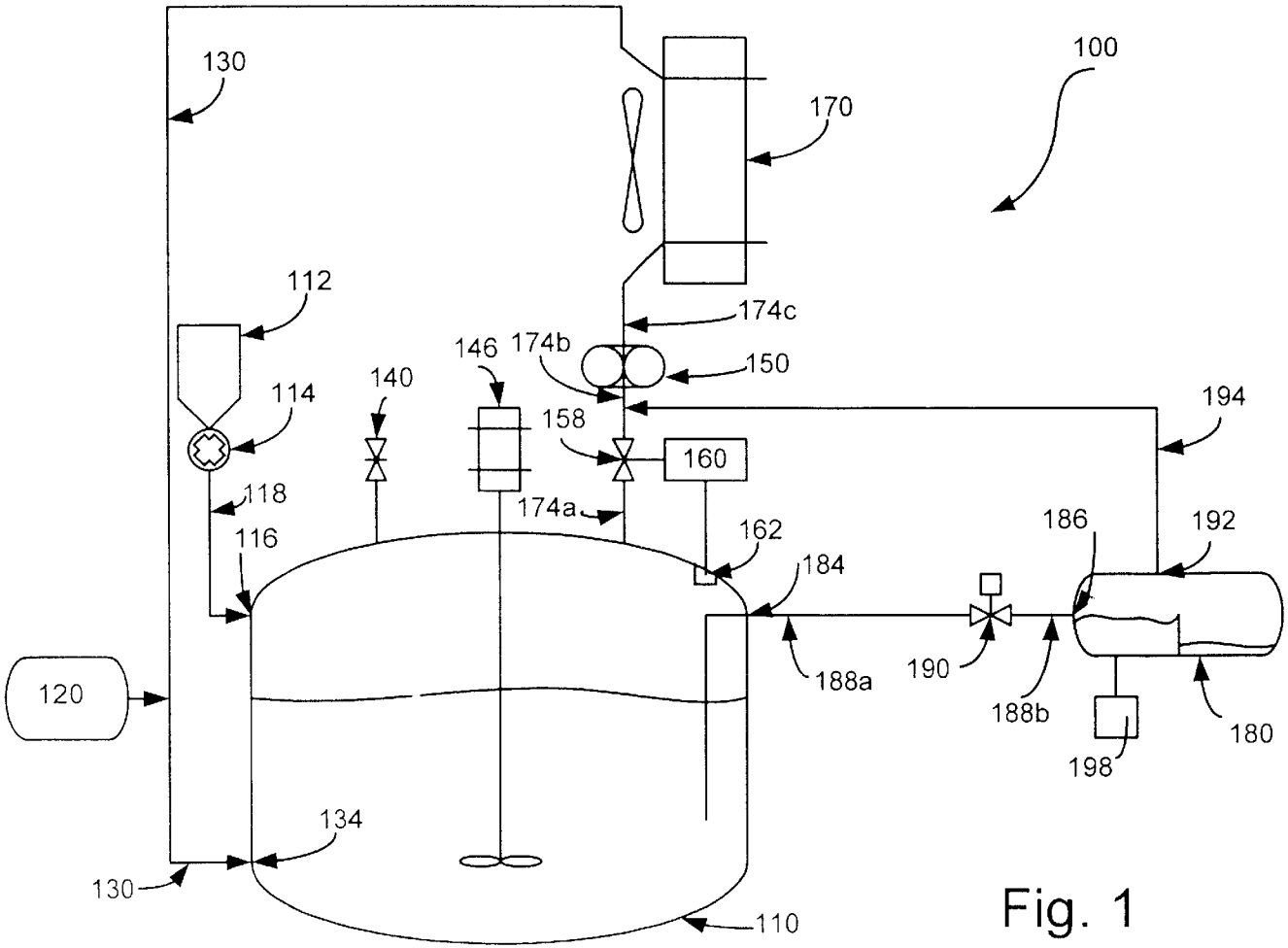
FIG. 1 is a schematic diagram of one embodiment of an apparatus for destruction of energetic materials.

More cost-effective approaches involving hydrolysis are described for destruction of energetic materials. Hydrolysis described herein includes the use of a volatile base in the presence of water to inactivate the energetic materials. In particular, hydroxide ions can be used to catalyze the destruction of the energetic materials. A reaction mixture for hydrolysis of energetic materials, thus, includes water and a volatile base in addition to the energetic materials. Preferably, the base used is ammonia that when added to water forms ammonium hydroxide. The approaches also include recovering unreacted base from the reaction mixture and/or the reaction products, processing the base and reusing the base in the same or another reaction mixture.

Apparatuses for the destruction of energetic materials are also contemplated for performing improved methods. The apparatus generally includes a tank and may also include a product container for receiving the products from the hydrolysis reaction occurring in the tank. The tank includes appropriate openings for introducing water, energetic materials and base into the tank. A base processor can be operatively connected to the tank and/or to the product container. Unreacted base from the reaction mixture and/or products can be introduced into the base compressor that, in turn, can reintroduce the recovered base back into the tank or place it in a storage vessel for later use. The apparatus can also include a condensor for cooling the recovered base and/or the reaction mixture.

Suitable energetic materials for hydrolysis can include, for example, nitrate esters and nitro aromatic type energetic materials. Specifically, suitable energetic materials include, for example, nitro compounds such as nitroerythrite, nitrosorbite, nitrostarch, nitrocellulose, nitroguanidine, aromatic nitro compounds such as trinitrotoluene (TNT), dinitrotoluene (DNT), nitric esters such as methyl nitrate, nitroglycerin, nitroamines such as cyclomethylenetrinitramine (RDX), cyclotetramethylenetetranitramine (HMX), ammonium picrate, black powder, single, double or triple base solid propellants and the like.

The methods for destruction of energetic materials include using a chemical reaction that includes base hydrolysis. The base used for hydrolysis can be advantageously recovered and recycled. Preferably, ammonium hydroxide is used as the base for the hydrolysis. In one embodiment, gaseous ammonia is introduced into a reaction mixture that includes water and energetic materials. The gaseous ammonia forms ammonium hydroxide when bubbled into the water. The ammonium hydroxide then catalyzes the destruction of the energetic materials.

The hydrolysis of the energetic materials is an exothermic process and generates a significant amount of heat. The generated heat can be sufficient to boil the reaction mixture, increase the pressure in the tank and evolve gas. The gas can be released from the tank and processed by a base processor. The base processor can be, for example, a gas compressor. The base processor may also compress water that can be present in the evolved gas. The compressed base may be cooled in a cooler/condenser prior to reintroduction back into the reaction mixture in the tank. In one exemplary emobodiment, the tank and, thus, the reaction mixture is cooled by a cooler prior to or during withdrawal of the evolved gas.

The methods described herein allow the unreacted base in the hydrolysis reaction to be recovered and reused for destruction of additional energetic materials. Generally, at least about 90 percent of the unreacted base is recovered and reused. Preferably, at least about 95 percent of the unreacted base, and more preferably at least about 98 percent of the unreacted base is recovered and reused. The recycling of the base results in lowered costs due to reuse of reactant chemicals. Costs are also lowered by bypassing the need to neutralize the reaction product with acids prior to additional processing. In addition, when ammonia is used, the ammonia can provide a reducing environment for subsequent disposal reactions involving combustion which eliminates the formation of oxides of nitrogen, thus, eliminating the need for further treatment in order to prevent air pollution.

Destruction of energetic materials have been described in, for example, U.S. Pat. No. 5,516,971, entitled "Process for Disposal of Waste Propellants and Explosives" to E. K. Hurley, U.S. Pat. No. 6,121,506, entitled "Method for Destroying Energetic Materials" to Abel et al. and U.S. Pat. No. 5,284,995 entitled "Method to Extract and Recover Nitramine Oxidizers from Solid Propellants Using Liquid Ammonia" to W. Melvin. In the Hurley patent, the energetic materials are disposed by the use of an aqueous caustic hydrolysis solution such as sodium hydroxide and potassium hydroxide. In the Abel patent, the destruction of energetic materials is accomplished through the use of solvated electrons. An active metal is combined with a nitrogenous base to produce solvated electrons. In the Melvin patent, liquid ammonia is used as a solvent to solubilize and later recover some of the components of solid propellants. The liquid ammonia is not used to react with and hydrolyze propellants as in the present invention using ammonium hydroxide.

FIG. 1 is an illustrative embodiment of an apparatus for destruction of energetic materials. Apparatus 100 includes tank 110, having inlets 116, 134 and outlets 154 and 184. Inlet 116 allows water and energetic materials from hopper 112 through connector 118 to enter into tank 110. The hopper may include lock 114. Lock 114 is a rotating device which is capable of feeding material while at the same time maintaining an "airlock" or not allowing escape of ammonia vapors. Inlet 134 of tank 110 allows entry of base from base dispenser 120 through connector 130. When a hydrolysis reaction is in progress, tank 110 includes the hydrolysis reaction components: water, energetic material and base. The tank can also include mixer 146 to more evenly disperse the components of the hydrolysis reaction.

Tank 110 also includes outlet 154 which is operatively connected to base processor 150. Base processor 150 preferably is a compressor. Base processor 150 is operatively connected to condenser 170 by connector 174*c*. The base processor can be any suitable commercially available compressor. An ammonia compressor, for example, can be purchased from Metro Refrigeration Industries in Ghaziabad, India and coupled to the tank. Pressure letdown valve 158 is disposed between base processor 150 and outlet 154. Valve 158 is actuated by controller 160. Controller 160 can include a sensor 162 that senses pressure in tank 110. Preferably, the evolved gas is the base, i.e. ammonia. The gas enters base processor 150 through connector 174*b*. Base processor 150 compresses the gaseous base and releases the compressed base into connector 174*c*. The compressed base enters condensor 170 through 174*c* and once cooled, exits condenser 170 into connector 130 that can, in turn, return the condensed base into tank 110. Condensor 170 is preferably a radiator type cooler/condensor for air cooling. Condensor 170 can be a coiled system with an attached fan. Alternatively, the cooler/condensor can be a water cooler. Base processor 150 is preferably an ammonia compressor.

Apparatus 100 also includes product container 180. Products from the hydrolysis reaction in tank 110 can be transferred from tank 110 into product container 180. Pressure letdown valve 190 is disposed between tank 110 and product container 180. The reaction products are removed from tank 110 through outlet 184 into connector 188*a*. Pressure may be released through valve 190 and prior to the reaction products entering connector 188*b*. The reaction products enter product container 180 through inlet 186. Additional unreacted base may be removed from product container 180 through outlet 192. The unreacted base can be transferred through connector 194 into connector 174*b* and into base processor 150. Tank 110 also includes pressure release valve 140 that opens when the pressure in tank 110 is about 20 PSIG or greater to prevent over pressure. Apparatus 100 may also include waste receptacle 198 that receives the products from product container 180. Waste receptacle 198 may, optionally, include a furnace.

Figure 2:
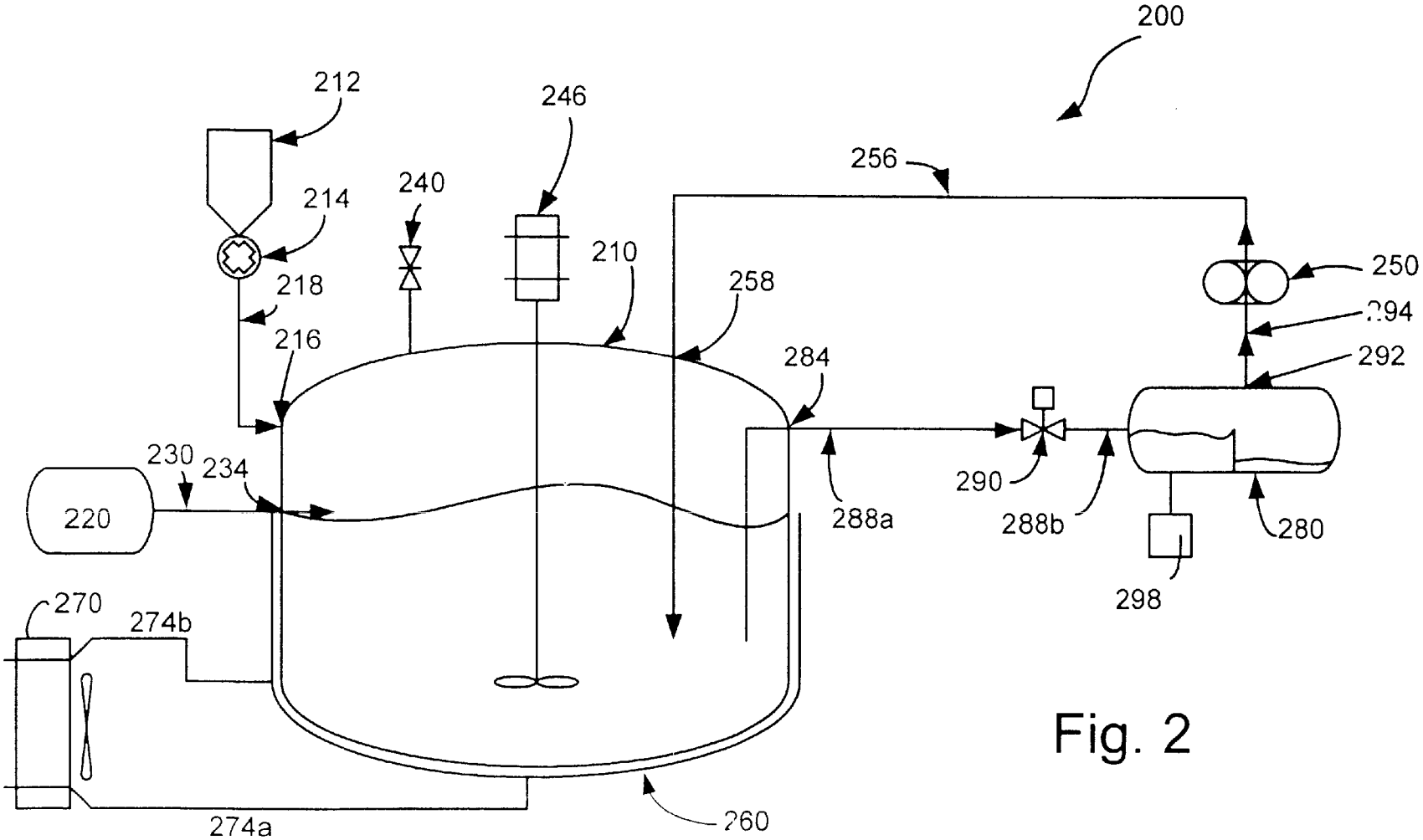
FIG. 2 is a schematic diagram of another embodiment of an apparatus for destruction of energetic materials.

In another illustrative embodiment shown in FIG. 2, apparatus 200 includes tank 210 having inlets 216, 234, 258 and outlet 284. Inlet 216 allows water and energetic materials from hopper 212 through connector 218 to enter into tank 210. The hopper may include lock 214. Inlet 234 of tank 210 allows entry of base from base dispenser 220 through connector 230. When a hydrolysis reaction is in progress, tank 210 includes the hydrolysis reaction components: water, energetic materials and base. The tank can also include mixer 246 to more evenly disperse the components of the hydrolysis reaction.

Tank 210 includes jacket 260 that surrounds a portion of tank 210. Jacket 260 withdraws heat from tank 210 due to coupling with cooler 270. A cooling medium such as water, oil or air circulates through jacket 260 and/or cooler/condensor 270 to transfer reaction heat out of tank 210. Cooler/condensor 270 is coupled to jacket 260 through connectors 274*a* and 274*b*. Cooler/condensor 270 cools tank 210. Cooler/condensor 270 is preferably a radiator (water to air) type cooler/condensor or a water cooler/condensor. Outlet 284 is connected to product container 280 through connectors 288*a*, 288*b* and valve 290. Valve 290 is a pressure letdown valve. Products of the hydrolysis reaction are transferred through outlet 284, connector 288*a*, 288*b* and into product container 280. Unreacted base present in product container is transferred to base processor 250 as a gas. Base processor 250 is operatively connected to product container 280 through outlet 292 and connector 294. Base processor 250 compresses the base and releases the compressed base into connector 256 The compressed base is in turn returned into tank 210 through inlet 258. Base processor 250 is preferably an ammonia compressor. Apparatus 200 also includes pressure release valve 240 that can release pressure when the pressure in the tank is about 20 PSIG or greater. Apparatus 200 may also include waste receptacle 298 that receives the products from product container 280. Waste receptacle 298 may, optionally, include a furnace.

The tanks used for the hydrolysis reaction can be containers that are resistant to the materials and conditions of the hydrolysis reaction. The tanks generally are pressure tanks. Preferred materials for tanks include, for example, stainless steel, carbon steel, PVC, Teflon, glass, or fiberglass reinforced plastic. Suitable tanks can be purchased, for example, from Chem-Tainer Industries, West Babylon, N.Y. The connectors in embodiments illustrated in FIG. 1 and FIG. 2 can be, for example, tubing, pipes and the like. Suitable connectors are preferably resistant to corrosion or other adverse affects related to contact with bases. Pressure release valves that can be suitable for the apparatus can include any number of commercially available valves. Valves can be purchased from, for example, All Valves, Clifton, N.J.

Suitable mixers include, for example, RSE side entering mixers purchased from Lightnin, Rochester, N.Y. Generally, the mixture is mixed at a rate sufficient to suspend any solids in the mixture. The suspension of the solids can be dependent on the density of the particles and the size of the solid particles.

Apparatus described above and/or other suitable apparatus can be used in the methods described herein for destruction of energetic materials. The destruction of energetic materials includes addition of a base to water and the energetic materials. In the methods described herein, unreacted base from the reaction mixture is advantageously recovered and preferably reused for further base catalyzed hydrolysis.

Water and energetic materials are generally placed in a tank. These may be fed into a hopper and then transferred into the tank. The rate of combining the water and base with the energetic materials can depend on a number of parameters including temperature of the reaction, mixing speed, particle size of the solids and the strength of the base. Changes in any of these parameters can affect the rate of combining the base with the water and energetic materials. In preferred embodiments, the combining is conducted at a rate of about a half ton of energetic material or less per minute per ton of reaction mixture.

A base dispenser can be connected to the tank as illustrated, for example, in FIG. 1 and FIG. 2. A variety of suitable bases can be used for the hydrolysis of the energetic materials including, for example, ammonia and isoamyl alcohol. Preferably, the base dispenser includes liquid ammonia. The boiling point of ammonia at 1 atmosphere is about −33 degrees Celsius. Thus, ammonia vapors, i.e. gaseous ammonia can be added to the tank that includes the energetic material and the water. Addition of gaseous ammonia into the water results in the formation of ammonium hydroxide. The presence of ammonium hydroxide, in particular the hydroxide ions, in the reaction mixture can catalyze the hydrolysis of the energetic materials.

Base catalyzed hydrolysis of the energetic materials is a highly exothermic reaction. Significant heat is released during this reaction. The released heat can result in boiling of the reaction mixture resulting in evolved gas. The pressure in the tank generally also increases as the hydrolysis reaction progresses due to the evolved gas.

The unreacted base in the hydrolysis reaction mixture can be recovered in a variety of ways. Generally, the recovery includes withdrawing the unreacted base as a gas. The base, i.e. gas, can then be compressed using a compressor and may be reintroduced into the tank to react with the water and form additional hydroxide, i.e. ammonium hydroxide. In some embodiments, the base may be additionally cooled/condensed prior to reintroduction into the tank.

In the illustrative embodiment shown in FIG. 1, the evolved gas can be released from tank 110 through outlet 154 and valve 158. If ammonia was used as the base, the evolved gas is ammonia. The unreacted base, i.e. gas, can be released when the pressure in tank 110 is about 10 PSIG or greater. The base is compressed by base processor 150. The pressure at the inlet of base processor 150 is about 0 PSIG and the pressure at the outlet of base processor 150 is about 100 PSIG. The compressed base is then cooled by cooler 170. The compressed and cooled base can then be reintroduced into tank 110 through connector 130 and inlet 134.

Unreacted base may also be recovered from product container 180. Product container 180 has an outlet 192 through which gas can escape and enter connector 194 and then connector **174*b*. From connector 174*b*, the gas enters base processor 150 similar to the gas from tank 110**. In this manner, additional unreacted base can be recovered and reintroduced into the reaction mixture.

In another illustrative embodiment shown in FIG. 2, tank 210 is fitted with jacket 260 for withdrawing heat from tank 210. Jacket 260 is operatively connected to cooler 270. In addition, the base, evolved as gas, is withdrawn into product container 280. The base leaves the tank through outlet 284, connector **288*a*, valve 290, connector 288*b* and into product container 280. Gas then is released from product container 280 through outlet 292 into base processor 250. The base after being compressed can be reintroduced back into tank 210, for example, through inlet 258**.

Generally, the concentration of the base in the reaction mixture is between about 2 percent by weight and 95 percent by weight. Preferably, the concentration of the base is between about 5 percent by weight and about 30 percent by weight and more preferably between about 5 percent by weight and about 20 percent by weight. The energetic material in the reaction mixture is generally less than about 50 percent by weight. Preferably, the energetic material is less than about 20 percent by weight.

The volumetric ratio of the energetic materials to the base and to the water can be between about 0.01 to about 2 parts energetic materials, about 0.5 to about 2 parts base and about 5 to about 20 parts water. Preferably, the ratio is between about 0.8 to about 1.2 parts energetic material, between about 0.8 to about 1.2 parts base and between about 8 parts to about 12 parts water.

The pH is generally about 14 during the reaction. Base content is controlled by a pressure/temperature relationship in which the amount of base in the tank is determined by the pressure noted as a function of the temperature set for the reaction. The reaction is preferably maintained between about 70 degrees Celsius and about 100 degrees Celsius and more preferably between about 80 degrees Celsius and about 90 degrees Celsius. The temperature can be maintained by controlling the amount of heat removed by the cooler. The pressure in the tank is generally maintained at about 20 PSIG or less, preferably at about 12 PSIG or less and more preferably between about 10 PSIG and about 8 PSIG.

Generally, the reaction time is dependent on the amount and particle size, the specific surface area of the energetic materials and/or the amount of base added to the reaction mixture. As the amount of base increases, the reaction time of the reaction mixture can decrease. As the amount of energetic material in the reaction mixture is increased, the reaction time can also increase. The reaction time can also depend on the particles size of the energetic materials. As the surface area of the particles increases, the reaction time can decrease. The reaction time can generally be between about 30 seconds and about 10 hours and preferably between about 1 hour and about 4 hours and more preferably between about 1 hour and about 2 hours for a batch in a continuous process. These reaction times can be adapted for a batch process and can be about the same as for a continuous process.

The methods described herein can be performed in a continuous manner. The energetic material, water and the base can be added continuously to the tank and the products can be continuously removed from the tank into the product container. Any unreacted base in the withdrawn product can be removed and recycled back into the tank. Make-up ammonia can be added to the tank, in addition to the recycled ammonia when the pressure at a given temperature falls below a set point. The product can then be further treated or disposed.

Alternatively, the reactions may be performed in a batch fashion. The energetic material and the water may be charged to the tank. The base may be added after the tank is sealed. At the completion of the reaction, the base is dissolved in the products and can be separated by using the base processor to evaporate the base out of the mixture and compress it as it leaves the reactor. The base can be withdrawn by, for example a pump and stored for reuse before the container is emptied.

The products of the hydrolysis reaction may be further treated or processed. Alternatively, the products may be ready for disposal after removal from the product container. The products may be transferred from the product container to a waste receptacle either for further processing and/or for disposal. The products may be removed from the product container and transferred into a furnace for burning. Alternatively, The products may be treated in a sewage treatment plant.

Although the present invention has been described with reference to preferred embodiments, workers skilled in the art will recognize that changes may be made in form and detail without departing from the spirit and scope of the invention.

What is claimed is:

1. A method for converting energetic materials comprising:

combining a volatile base with energetic materials and water to obtain a reaction mixture that hydrolyzes the energetic materials;

recovering unreacted base;

compressing the unreacted base; and combining the unreacted base with the water containing energetic materials.

2. The method of claim 1 wherein the volatile base is liquid ammonia.

3. The method of claim 1 wherein the volatile base is gaseous ammonia.

4. The method of claim 1 wherein the unreacted base recovered is gaseous ammonia.

5. The method of claim 1 wherein the recovering of unreacted base comprises evaporating ammonia from the reaction mixture.

6. The method of claim 1 wherein the method further comprises mixing the reaction mixture.

7. The method of claim 1, wherein the unreacted base is recovered after the hydrolyzed energetic materials and unreacted base from the reaction mixture are transferred to a product container.

8. The method of claim 1 wherein the unreacted base is cooled prior to introduction into water containing energetic materials.

9. The method of claim 1 wherein the amount of volatile base in the reaction mixture is between about 2 percent by weight and about 95 percent by weight of the water.

10. The method of claim 1 wherein the amount of volatile base in the reaction mixture is between about 5 percent by weight and about 30 percent by weight of the water.

11. The method of claim 1 wherein the amount of energetic material is about 50 percent by weight of the reaction mixture or less.

12. The method of claim 1 wherein the amount of energetic material is about 20 percent by weight of the mixture or less.

13. The method of claim 1 wherein the reaction mixture is maintained between about 70 degrees Celsius and about 100 degrees Celsius.

14. The method of claim 1 wherein the combining is maintained between about 8 PSIG and about 20 PSIG.

15. The method of claim 1 wherein the reaction mixture is hydrolyzed for between about 30 seconds and about 10 hours.

16. The method of claim 1 wherein the combining is conducted at a rate of about a half ton of energetic material or less per minute per ton of reaction mixture.

* * * * *